US012029259B2

(12) United States Patent
Kim

(10) Patent No.: US 12,029,259 B2
(45) Date of Patent: Jul. 9, 2024

(54) FUSED BRASSIERE

(71) Applicant: Dong Hyun Kim, Gyeonggi (KR)

(72) Inventor: Dong Hyun Kim, Gyeonggi (KR)

( * ) Notice: Subject to any disclaimer, the term of this patent is extended or adjusted under 35 U.S.C. 154(b) by 0 days.

(21) Appl. No.: 17/041,013

(22) PCT Filed: Dec. 30, 2019

(86) PCT No.: PCT/KR2019/018742
§ 371 (c)(1),
(2) Date: Sep. 24, 2020

(87) PCT Pub. No.: WO2021/125420
PCT Pub. Date: Jun. 24, 2021

(65) Prior Publication Data

US 2022/0312856 A1 Oct. 6, 2022

(30) Foreign Application Priority Data

Dec. 19, 2019 (KR) ..... 10-2019-0171065

(51) Int. Cl.
*A41C 3/00* (2006.01)
*A41C 3/14* (2006.01)
*A41H 43/04* (2006.01)

(52) U.S. Cl.
CPC ..... *A41C 3/0035* (2013.01); *A41C 3/144* (2013.01); *A41H 43/04* (2013.01)

(58) Field of Classification Search
CPC ..... A41C 3/0035; A41C 3/144; A41C 5/005; A41H 43/04
(Continued)

(56) References Cited

U.S. PATENT DOCUMENTS 6,000,994 A * 12/1999 Salotto ..... A41C 3/0014 2/243.1
7,690,960 B2 * 4/2010 Takahashi ..... H10K 71/00 445/24
(Continued)

FOREIGN PATENT DOCUMENTS

JP 2016186142 A 10/2016
KR 200261834 1/2002
(Continued)

OTHER PUBLICATIONS

International Search Report issued in corresponding International Patent Application No. PCT/KR2019/018742 dated Jul. 2019.

*Primary Examiner* — Gloria M Hale
(74) *Attorney, Agent, or Firm* — Finch & Maloney PLLC

(57) ABSTRACT

A fused brassiere having an elastic outer fabric; an elastic lining bonded to the outer fabric compressed against an inner surface of the outer fabric to form first and second pocket portions; first and second cup-shaped pad portions inserted into the pocket portions, respectively; and a core member formed in a region between the pocket portions and in a circumferential portion of the pocket portions and disposed between and bonded together when the outer fabric and the lining are compressed against each other. The core member includes connecting portions which surround and connect lower and upper portions of the pocket portions to each other. The cup-shaped pad portions include first and second breast points, respectively. The connecting portions surround the pocket portions so that when viewed from the front, opposite ends of a first connecting portion are disposed higher than the first and second breast points, respectively.

7 Claims, 8 Drawing Sheets

(58) Field of Classification Search
USPC ..... 450/39
See application file for complete search history.

(56) References Cited

U.S. PATENT DOCUMENTS 7,833,082 B2 * 11/2010 Bugada ..... A41C 5/00 450/39
7,862,401 B2 * 1/2011 Watrin ..... A41C 5/005 450/39
9,210,955 B2 * 12/2015 Dandapure ..... A41C 5/005
9,480,287 B2 * 11/2016 Black ..... A41C 3/0057
10,368,590 B2 8/2019 Diaz et al.
10,440,003 B2 * 10/2019 Averboch ..... G06F 40/30
10,477,902 B1 * 11/2019 Blecha ..... A41C 3/0057
11,044,954 B2 * 6/2021 Misseldine ..... A41C 3/0057
2002/0106970 A1 * 8/2002 Falla ..... A41B 17/00 450/1
2003/0092355 A1 * 5/2003 Rabinowicz ..... A41C 5/00 450/1
2004/0053557 A1 * 3/2004 Moyer ..... A41C 3/00 450/41
2006/0046614 A1 * 3/2006 Hsu ..... A41C 3/0014 450/1
2006/0099884 A1 * 5/2006 Falla ..... A41C 5/005 156/267
2006/0099886 A1 * 5/2006 Rubin ..... B24B 49/12 451/6
2007/0190896 A1 * 8/2007 Yu ..... A41C 5/005 450/39
2008/0076324 A1 * 3/2008 Liu ..... B29C 45/14778 450/39
2010/0288434 A1 * 11/2010 Falla ..... A41B 17/00 156/267
2010/0297912 A1 * 11/2010 Falla ..... A41B 17/00 450/39
2019/0125007 A1 * 5/2019 Liu ..... A41C 5/005
2019/0174841 A1 * 6/2019 Bastug ..... A41C 3/0007
2021/0053586 A1 * 2/2021 Domeyer ..... G06T 11/00
2022/0248775 A1 * 8/2022 Todaro ..... A41C 3/144

FOREIGN PATENT DOCUMENTS

KR 101391313 B1 5/2014
KR 1020160044020 A 4/2016
KR 1020180077269 A 7/2018

* cited by examiner

FUSED BRASSIERE

TECHNICAL FIELD

The present invention relates to a fused brassiere.

BACKGROUND ART

A brassiere is a sort of underwear to protect a wearer's breasts or create a beautiful appearance. The brassiere is underwear and also a fashion item, and may thus have various designs or create a new trend to express the wearer's individuality.

The brassiere has a basic function of preventing the breasts from appearing sagging or shaking. However, it is controversial that a member such as a wire of the brassiere, which is used to support and gather the breasts, may block lymph flow and increase the incidence of breast cancer.

Technology has also been developed to manufacture a brassiere providing a comfortable fit while satisfying its basic function. Among the brassieres, a fused brassiere may refer to a sort of seamless brassiere having no seam and providing a comfortable yet voluminous fit and a stylish appearance by bonding fabrics having high elasticity to each other using heat, pressure and the like. However, the fused brassiere using a material having elasticity may be vulnerable to the shaking or displacement of the breasts. To solve this problem, Korean Patent Publication No. 10-1391313 and the like propose a method of adding a shape-retaining member having no elasticity. However, this method still has a problem that even though the shape-retaining member is disposed on lower end portions of the breasts and secures its support force thereto, the shape-retaining member is not sufficient to prevent deterioration of the function of gathering the breasts.

PRIOR ART DOCUMENT

Korean Patent Publication No. 10-1391313 (May 7, 2014)
Japanese Patent Laid-Open Publication No. 2016-186142 (Oct. 27, 2016)
Korean Utility Model Publication No. 20-0261834 (Jan. 24, 2002)

DISCLOSURE

Technical Problem

An object of the present invention is to provide a fused brassiere substantially preventing the breasts from being far apart from each other while providing a more comfortable fit by bonding fabrics having elasticity to each other by fusing.

Another object of the present invention is to provide a fused brassiere configured to have a bust-up function while providing a more comfortable fit by coupling fabrics having elasticity to each other by fusing.

Technical Solution

According to an embodiment of the present invention, there is provided a fused brassiere including: an outer fabric having elasticity; a lining having elasticity and configured to form a first pocket portion and a second pocket portion by being bonded to the outer fabric by being compressed against an inner surface of the outer fabric; a first cup-shaped pad portion and a second cup-shaped pad portion inserted into the first pocket portion and the second pocket portion, respectively; and a core member having no elasticity, formed in a region between the first pocket portion and the second pocket portion and in a circumferential portion of the first pocket portion and the second pocket portion, disposed between the outer fabric and the lining, and bonded together when the outer fabric and the lining are compressed against each other.

In an embodiment of the present invention, the outer fabric may include: a front portion in which the first pocket portion and the second pocket portion are formed; a shoulder support portion extending from an upper end of the front portion and supported on a wearer's shoulder; and a rear portion extending from the shoulder support portion, coupled to side ends of the front portion, and supported on the wearer's back.

In an embodiment of the present invention, the edge and middle portions of the lining may each have a bonding region in which the lining and the outer fabric are compressed against each other, and the core member is disposed in the bonding region.

In an embodiment of the present invention, the core member may have the form of a mesh net through which an adhesive is able to penetrate.

In an embodiment of the present invention, the core member may include: a first horizontal connecting portion connecting an edge of a lower end of the first pocket portion and that of the second pocket portion; a second horizontal connecting portion connecting an edge of an upper end of the first pocket portion and that of the second pocket portion; and a vertical connecting portion connecting the first horizontal connecting portion and the second horizontal connecting portion to each other.

In an embodiment of the present invention, the first horizontal connecting portion, the second horizontal connecting portion and the vertical connecting portion may be formed integrally with one another.

In an embodiment of the present invention, the first cup-shaped pad portion may include a first breast point, and the second cup-shaped pad portion may include a second breast point, and when viewed from the front, the second horizontal connecting portion may be disposed higher than the first breast point and the second breast point.

In an embodiment of the present invention, the first horizontal connecting portion, the second horizontal connecting portion and the vertical connecting portion may be formed in the shape of a band having a variable width.

In an embodiment of the present invention, the core member may include a first core member and a second core member, the first core member including: a first horizontal connecting portion connecting an edge of a lower end of the first pocket portion and that of the second pocket portion; and an upward extension portion extending upward from a middle of the first horizontal connecting portion, and the second core member including: a second horizontal connecting portion connecting an edge of an upper end of the first pocket portion and that of the second pocket portion; and a downward extension portion extending downward from a middle of the second horizontal connecting portion.

In an embodiment of the present invention, the upward extension portion and the downward extension portion may be spaced apart from each other with a predetermined gap therebetween.

Advantageous Effects

According to the fused brassiere of the present invention, it is possible to provide the wearer with a comfortable fit by coupling the lining and the outer fabric, each having elasticity, to each other, and effectively prevent the breasts from being far apart from each other by disposing the core member having no elasticity between the first pocket portion and the second pocket portion.

In an embodiment of the present invention, the core member may be made of a yarn in the form of the mesh net and having no elasticity, and may secure a strong support force when bonded.

In another embodiment of the present invention, the core member may include: the first horizontal connecting portion connecting the lower end of the first pocket portion and that of the second pocket portion; the second horizontal connecting portion connecting the upper end of the first cup-shaped portion and that of the second cup-shaped portion; and the vertical connecting portion connecting the first horizontal connecting portion and the second horizontal connecting portion to each other. Here, the upper portions as well as the lower portions of the first pocket portion and the second pocket portion may be connected to each other in a non-elastic manner, and the breasts may thus be minimally apart from each other.

In an embodiment of the present invention, the first connecting portion may be formed to surround the lower ends and the sides of the first pocket portion and the second pocket portion, thereby enhancing its function of gathering and supporting the breasts.

In addition, it is possible to increase the supporting force of the first and second pocket portions by also disposing the second connecting portion to surround the upper ends of the first and second pocket portions and to become close to the ends of the first connecting portion.

BEST MODE

Hereinafter, a fused brassiere according to the present invention is described in detail with reference to the accompanying drawings.

Figure 1:
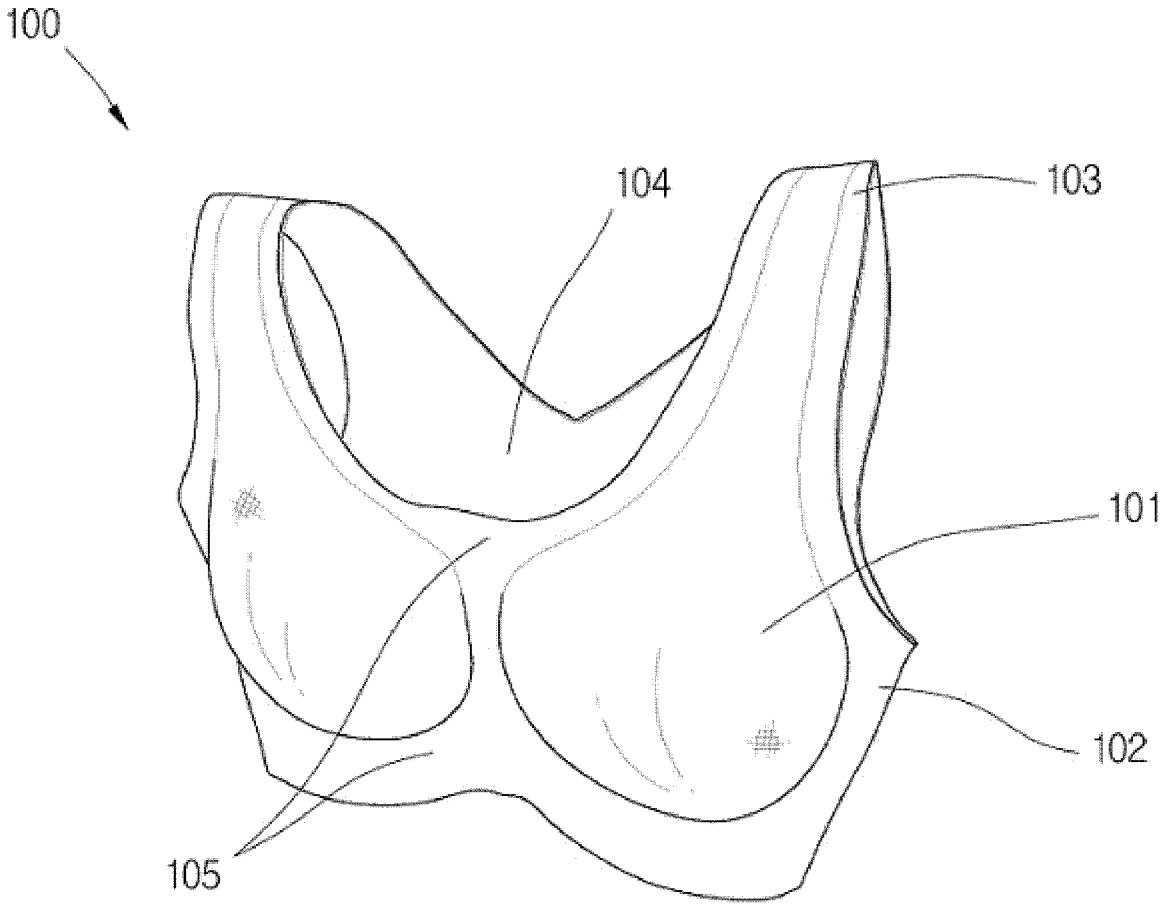
FIG. 1 is a schematic perspective view of a fused brassiere 100 according to a first embodiment of the present invention.

FIG. 1 is a schematic perspective view of a fused brassiere 100 according to a first embodiment of the present invention. The fused brassiere 100 of the present invention may include a cup-shaped portion 101, a wing portion 102, a shoulder support portion 103 and a rear portion 104. A coupling region 105 may be formed to form the cup-shaped portion 101. The coupling region 105 may include a portion where an outer fabric and a lining are bonded to each other, as described below, and a portion preventing the breasts from being far apart from each other.

Figure 2:
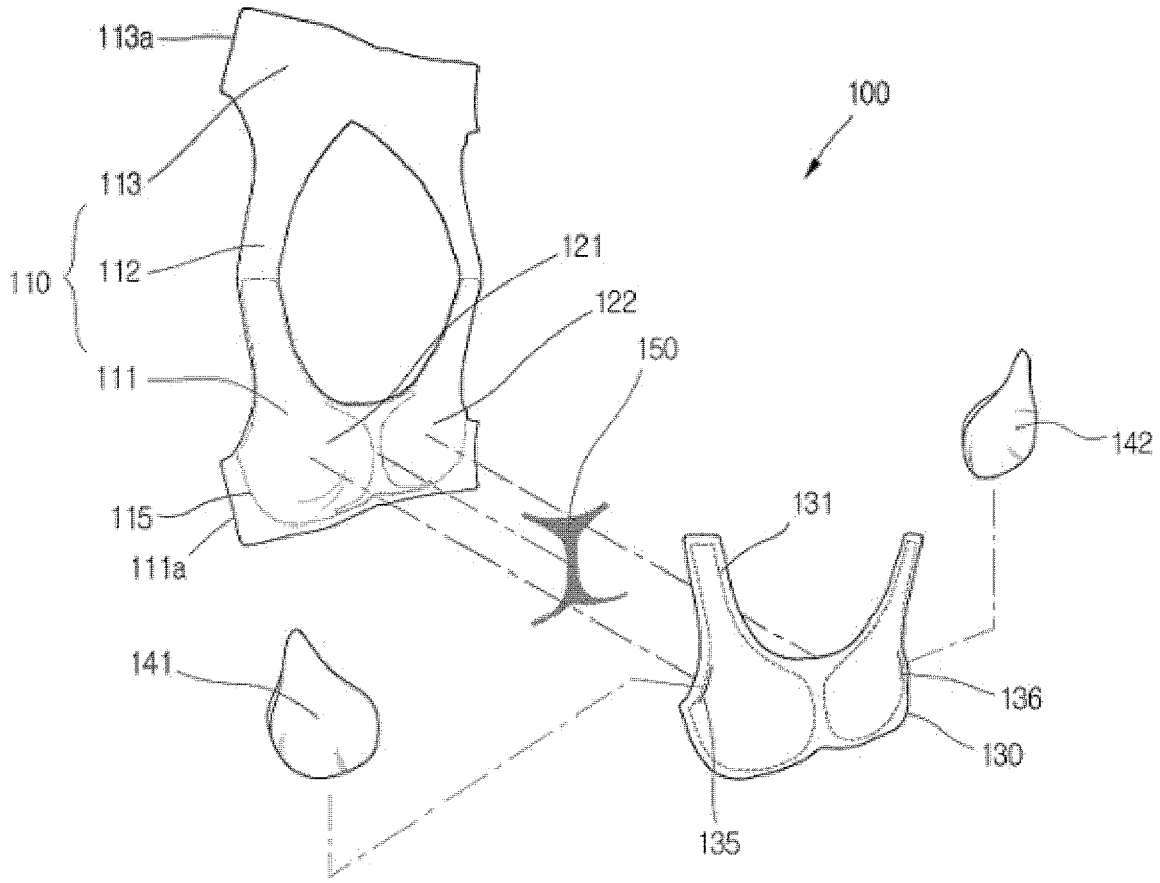
FIG. 2 is an exploded perspective view showing the shape and position of each member of the fused brassiere 100 of FIG. 1, in which each member is yet to be coupled to each other.
Figure 3:
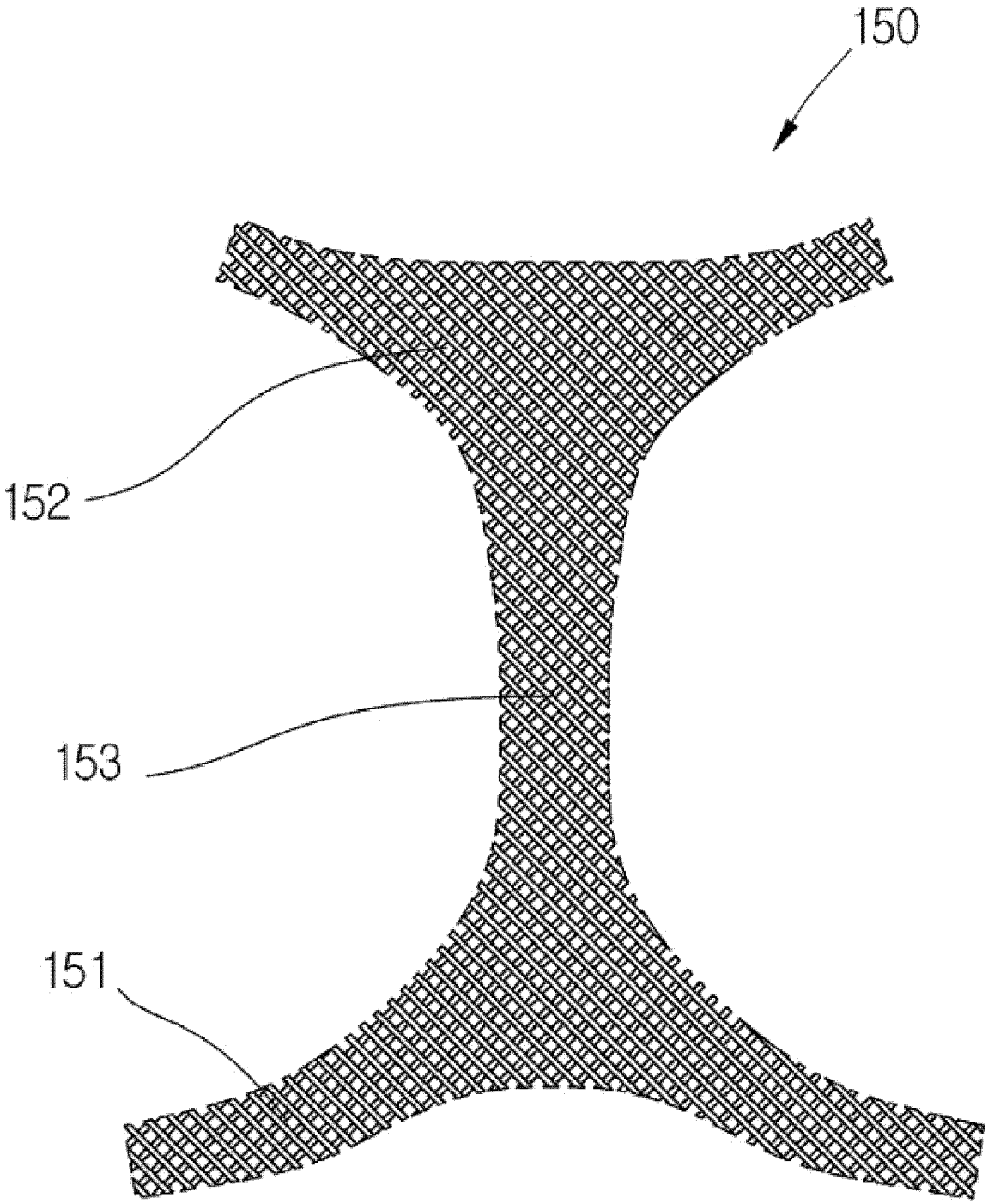
FIG. 3 is a plan view of a core member 150 shown in FIG. 1.

FIG. 2 is an exploded perspective view showing the shape and position of each member of the fused brassiere 100 of FIG. 1, in which each member is yet to be coupled to each other; and FIG. 3 is a plan view of a core member 150 of the present invention.

As shown in the above drawings, the fused brassiere 100 may have an outer fabric 110, a lining 130, pad portions 141 and 142, and a core member 150. A fabric having elasticity may be used for the outer fabric 110 and the lining 130. The same fabric may be used for the outer fabric 110 and the lining 130.

The lining 130 may be configured to form the cup-shaped portion 101 described above into which the pad portions 141 and 142 are inserted. In detail, the lining 130 may be configured to form a first pocket portion 121 and a second pocket portion 122 by being bonded to the outer fabric by being compressed against an inner surface of the outer fabric 110. To this end, the edge and middle portions of the lining 130 may each have a bonding region 131 in which the lining and the outer fabric 110 may be compressed against each other. Similarly, the corresponding portions of the outer fabric 110 may each have a coupling region 115 in which the lining 130 and the outer fabric may be compressed against each other.

The pad portions 141 and 142 may be the first cup-shaped pad portion 141 inserted into the first pocket portion 121 and the second cup-shaped pad portion 142 inserted into the second pocket portion 122, respectively. Incisions 135 and 136 may be formed in the lining 130, respectively, for the first cup-shaped pad portion 141 and the second cup-shaped pad portion 142 to be inserted into the first pocket portion 121 and the second pocket portion 122, respectively. The lining 130 and the outer fabric 110 are fabrics having elasticity, and the first cup-shaped pad portion 141 and the second cup-shaped pad portion 142 may thus be used to lift the breasts or to provide a more voluminous fit while forming a three-dimensional shape of the brassiere.

The core member 150 may be made of a material having lower elasticity than the outer fabric 110 and lining 130. This core member 150 may be formed in a region between the first pocket portion 121 and the second pocket portion 122 and in a circumferential portion of the first pocket portion 121 and the second pocket portion 122, may be disposed between the outer fabric 110 and the lining 130, and may be bonded together when the outer fabric 110 and the lining 130 are compressed against each other. As shown in FIG. 3, the core member 150 may have the form of a mesh net through which an adhesive is able to permeate. Alternatively, the core member 150 may have the form of a film. The core member 150 may be formed to include: a first horizontal connecting portion 151 connecting an edge of a lower end of the first pocket portion 121 and that of the second pocket portion 122; a second horizontal connecting portion 152 connecting an edge of an upper end of the first pocket portion 121 and that of the second pocket portion 122; and a third connecting portion 153 connecting the first connecting portion 151 and the second connecting portion 152 to each other. The first connecting portion 151, the second connecting portion 152 and the third connecting portion 153 may be formed integrally with one another in the shape of a band having a variable width.

Figure 4:
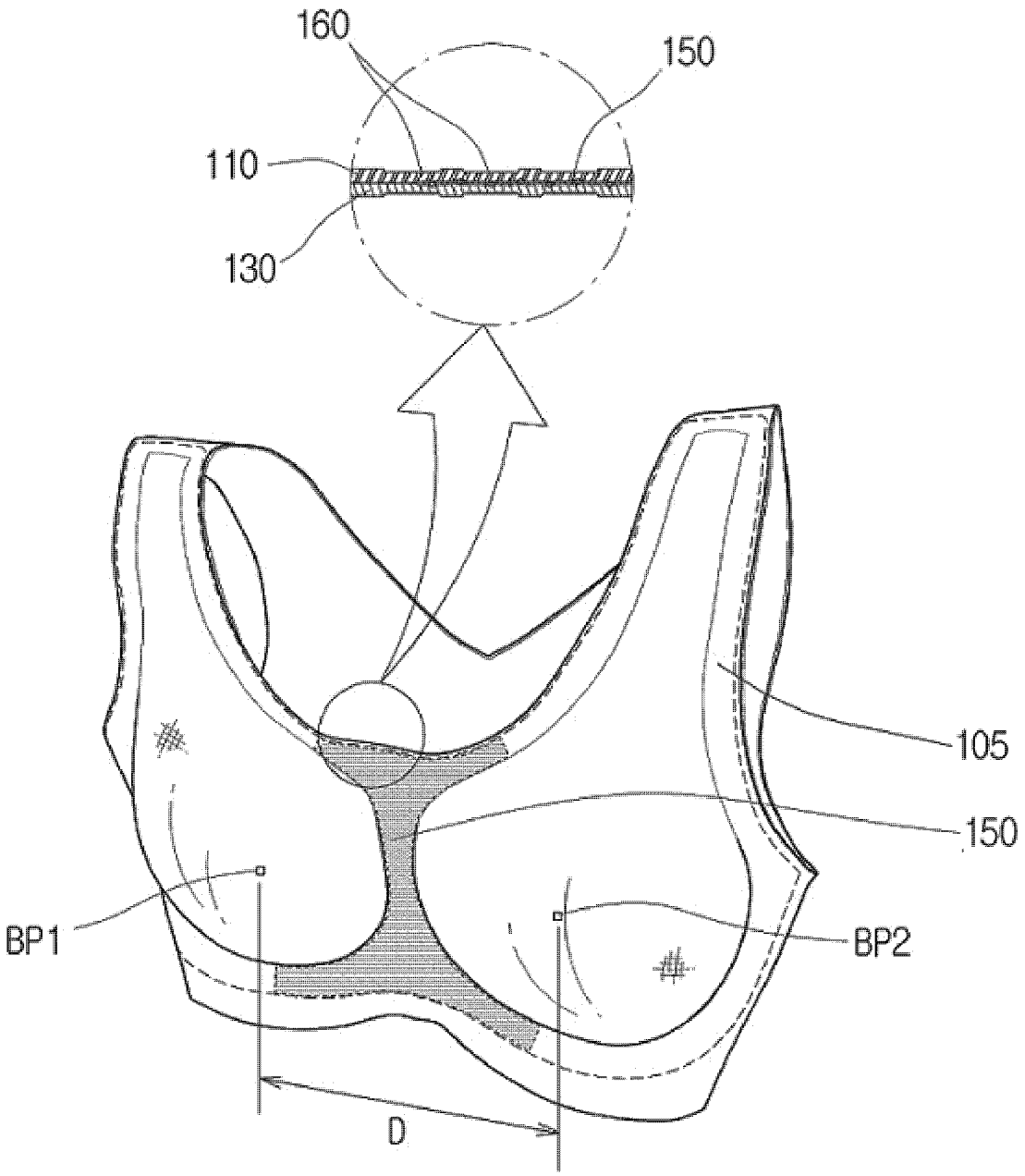
FIG. 4 is a transparent perspective view of the fused brassiere 100 to which the core member 150 of FIG. 3 is applied.

As shown in FIG. 4, the first cup-shaped pad portion 141 may include a first breast point BP1, and the second cup-shaped pad portion 142 may include a second breast point BP2, respectively. In this case, when viewed from the front, the second connecting portion 152 may be disposed higher than the first breast point BP1 and the second breast point BP2. As a result, in the fused brassiere 100 of the present invention, the first connecting portion 151 at the lower ends and the second connecting portion 152 at the upper ends may effectively prevent a distance D between the first breast point BP1 and the second breast point BP2 from being large. As shown in an enlarged cross-sectional view of FIG. 4, a compression groove 160 may be formed as the outer fabric 110 and the lining 130 are compressed against each other in the form of a plurality of pressed dots.

As shown in FIG. 2 again, the outer fabric 110 may include: a front portion 111 in which the first pocket portion 121 and the second pocket portion 122 are formed; a shoulder support portion 112 extending from an upper end of the front portion 111 and supported on a wearer's shoulder; and a rear portion 113 extending from the shoulder support portion 112 and coupled to side ends of the front portion 111. That is, the front portion 111, the shoulder support portion 112 and the rear portion 113, forming the outer fabric 110, may be cut integrally with one another. In this state, the core member 150 and the lining 130 may be sequentially disposed on an inner surface of the front portion 111, and coupled to one another along the coupling regions 115 and 131 using heat or pressure. Next, opposite side ends 111*a* of the front portion 111 and opposite side ends 113*a* of the rear portion 113 may each be coupled to each other to form a shape of the brassiere which may be worn on a wearer's body. When completing the coupling between the members, the first cup-shaped pad portion 141 and the second cup-shaped pad portion 142 may be inserted into the incisions 135 and 136, respectively. The fused brassiere 100 formed through this process may provide the wearer with a comfortable fit by having excellent elasticity without using seams or wires. In addition, the core member 150 disposed in the region between the first pocket portion 121 and the second pocket portion 122 and in the circumferential portion of the first pocket portion 121 and the second pocket portion 122 may prevent the breasts from moving and effectively block the breasts from being far apart from each other even in an activity such as exercise or stretching.

Unlike the above description, it is also possible to manufacture the outer fabric 110 to include neither the shoulder support portion 112 nor the rear portion 113 and only the front portion 111. In this case, the shoulder support portion and the rear portion may be manufactured separately from the outer fabric 110 and then attached to the outer fabric 110.

Figure 5:
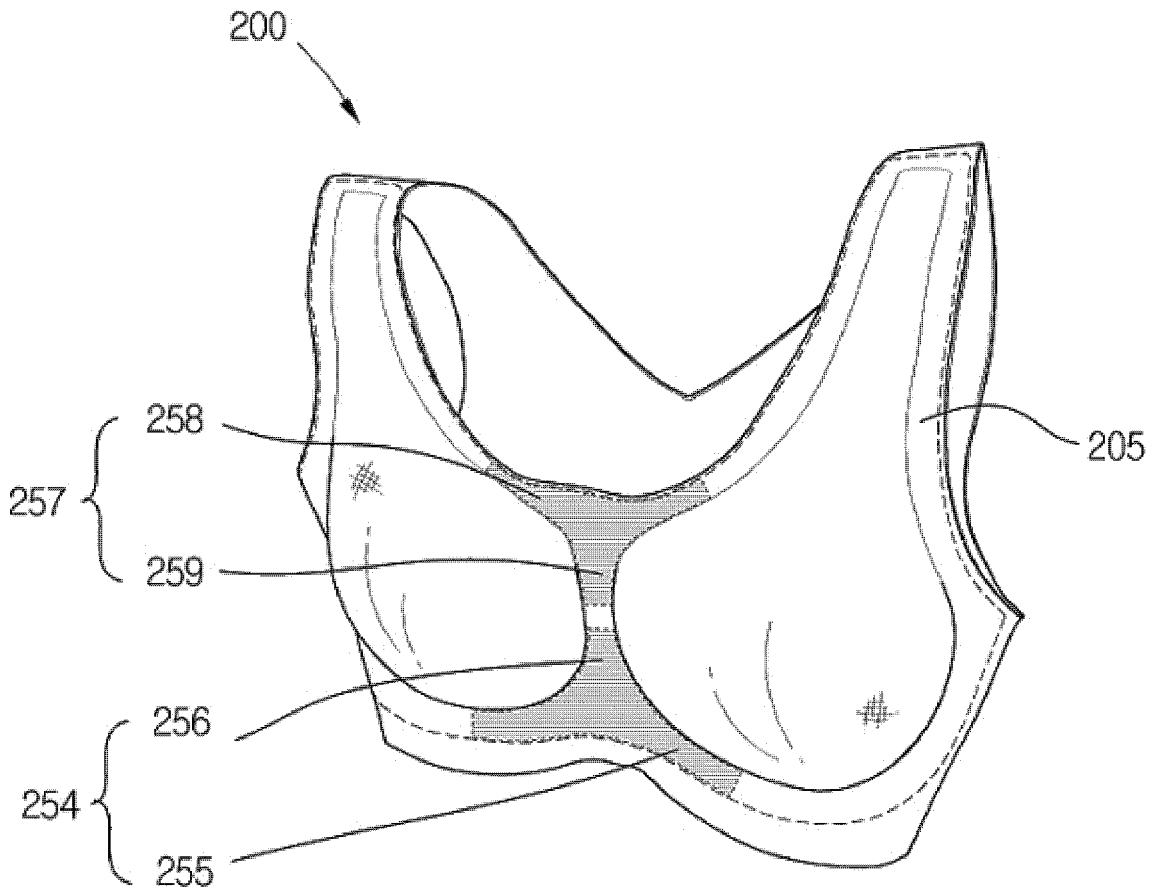
FIG. 5 is a perspective view of a fused brassiere 200 according to a second embodiment of the present invention.

FIG. 5 is a perspective view of a fused brassiere 200 according to a second embodiment of the present invention. In this embodiment, the core member may be formed to include: a first core member 254; and a second core member 257. The first core member 254 may include: a first horizontal connecting portion 255 connecting an edge of a lower end of the first pocket portion and that of the second pocket portion; and an upward extension portion 256 extending upward from a middle of the first connecting portion 255. The second core member 257 may include: a second horizontal connecting portion 258 connecting an edge of an upper end of the first pocket portion and that of the second pocket portion; and a downward extension portion 259 extending downward from a middle of the second connecting portion 258. The upward extension portion 256 and the downward extension portion 259 may be spaced apart from each other with a predetermined gap therebetween. Accordingly, the fused brassiere 200 may be prevented from being stretched in a horizontal direction by the first core member 254 and the second core member 257, thereby preventing the breasts from being far apart from each other similar to the previous embodiment; and some elasticity may be provided in a vertical direction by the gap between the first core member 254 and the second core member 257.

Figure 6:
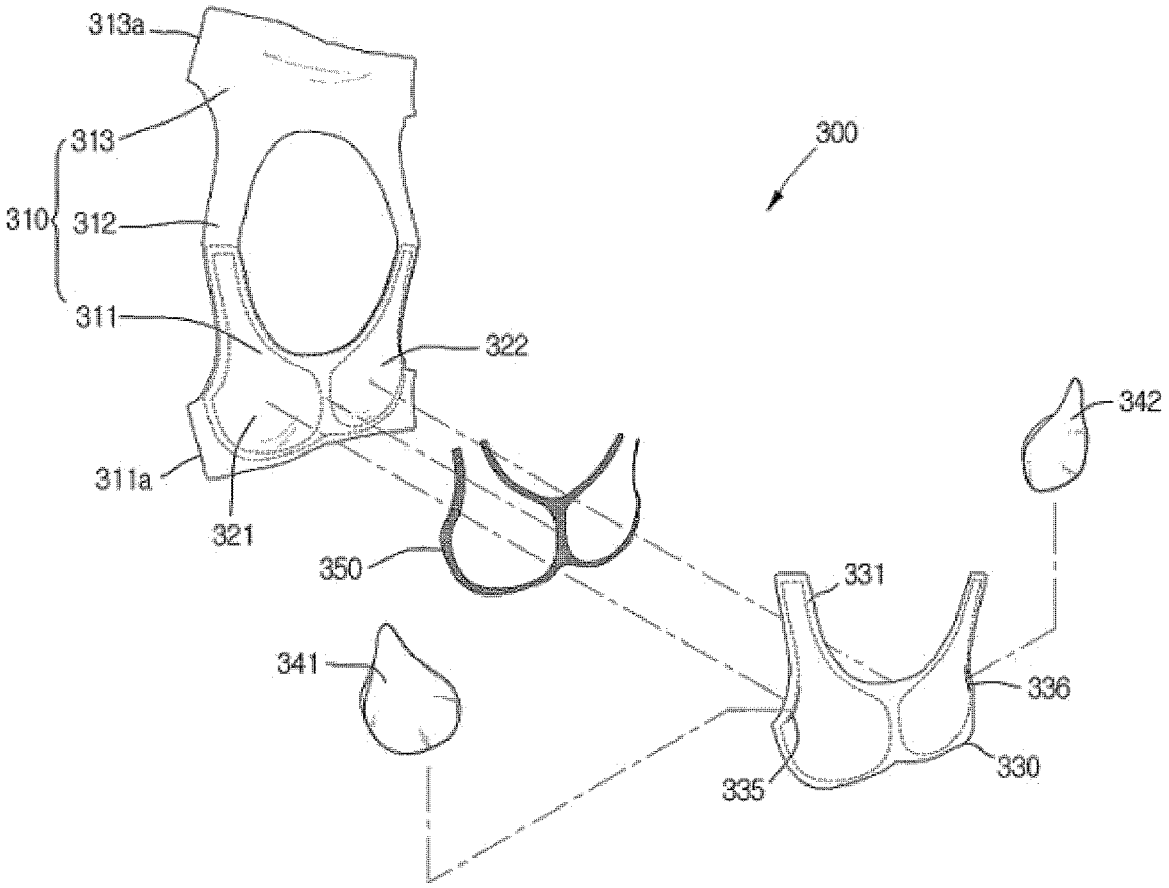
FIG. 6 is an exploded perspective view showing the shape and position of each member of a fused brassiere 300 according to a third embodiment of the present invention, in which each member is yet to be coupled to each other.
Figure 7:
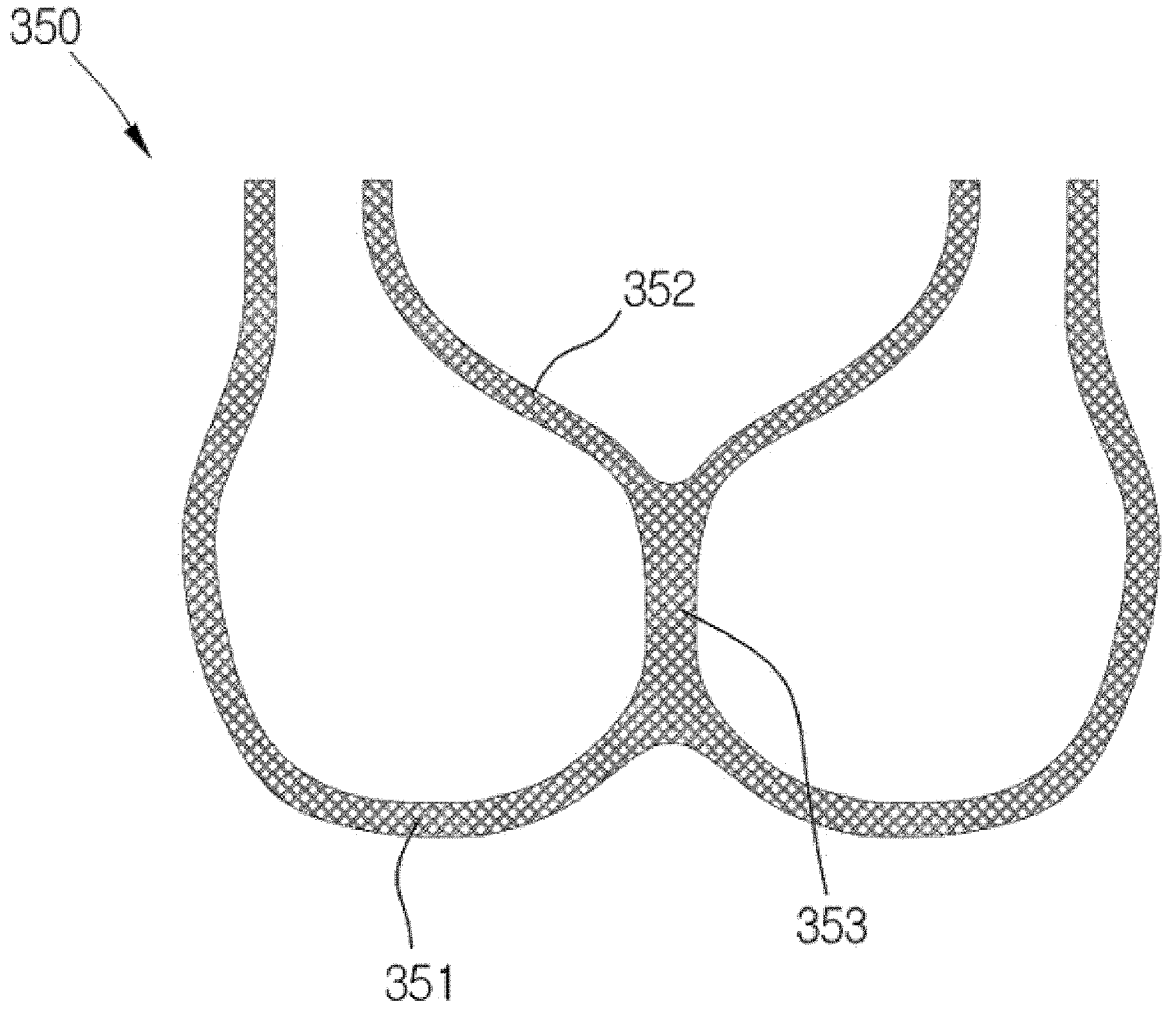
FIG. 7 is a plan view of a core member 350 shown in FIG. 6.
Figure 8:
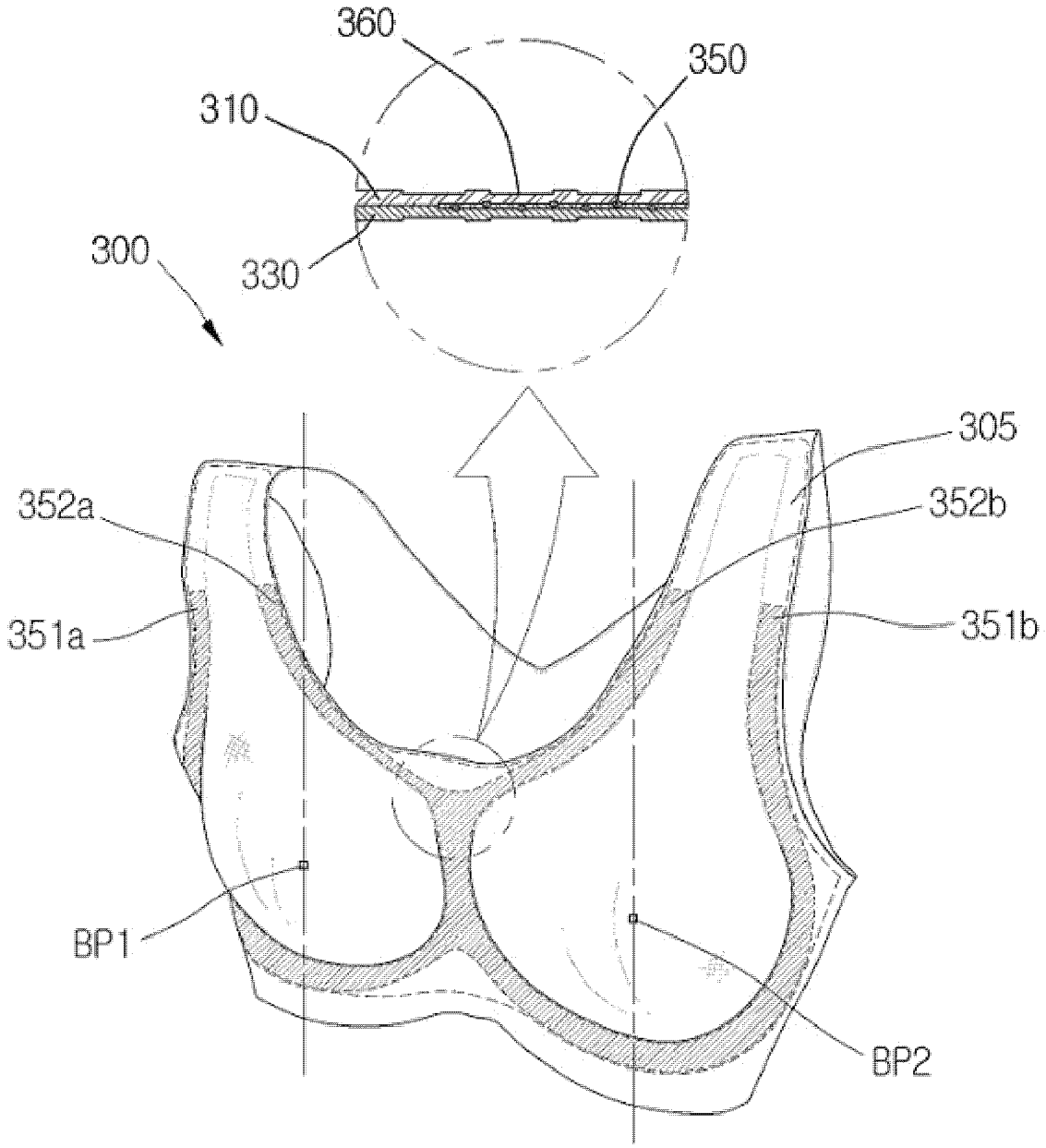
FIG. 8 is a transparent perspective view of the fused brassiere 300 to which the core member of FIG. 7 is applied.

FIG. 6 is an exploded perspective view showing the shape and position of each member of a fused brassiere 300 according to a third embodiment of the present invention, in which each member is yet to be coupled to each other; FIG. 7 is a plan view of a core member 350 shown in FIG. 6; and FIG. 8 is a transparent perspective view of the fused brassiere 300 to which the core member of FIG. 7 is applied.

The fused brassiere 300 of this embodiment may also include: an outer fabric 310 having elasticity; a lining 330 having elasticity; a core member 350 having elasticity lower than the outer fabric 310 and the lining 330 and attached to the inside of a bonding region 305 between the outer fabric 310 and the lining 330 by thermocompression.

A fabric having elasticity may be cut to prepare the outer fabric 310 forming a front portion 311, a rear portion 313 and a shoulder support portion 312. The lining 330 may be compressed together with the core member 350 against an inner surface of the front portion 311, and a first pocket portion 321 and a second pocket portion 322 may be formed by a coupling region 331. A first cup-shaped pad portion 341 and a second cup-shaped pad portion 342 may be inserted into the first pocket portion 321 and the second pocket portion 322 through a first incision 335 and a second incision 336, respectively.

As shown in FIG. 7, the core member 350 of the present embodiment may include: a first connecting portion 351 formed to surround lower portions of the first pocket portion 321 and the second pocket portion 322; a second connecting portion 352 formed to surround upper portions of the first pocket portion 321 and the second pocket portion 322; and a third connecting portion 353 connecting the first connecting portion 351 and the second connecting portion 352 to each other. The first connecting portion 351, the second connecting portion 352 and the third connecting portion 353 may be formed integrally with one another in the shape of a band having a variable width. The core member 350 having the first connecting portion 351, the second connecting portion 352 and the third connecting portion 353 may be made by cutting a mesh fabric having no elasticity or elasticity lower than the outer fabric 310 or the lining 330. An adhesive may permeate and penetrate through the core member 350 in the form of a mesh net, thereby increasing an adhesive strength. As shown in an enlarged view of FIG. 8, a compression groove 360 may be formed as the outer fabric 310, the core member 350, and the lining 330 are compressed against one another by a dot compression device.

As shown in FIG. 8, when viewed from the front, the first connecting portion 351 and opposite ends 351*a* and 351*b* of the first horizontal connecting portion may be disposed higher than a first breast point BP1 of the first cup-shaped pad portion 341 and a second breast point BP2 of the second cup-shaped pad portion 342, respectively. That is, unlike FIG. 4, the first connecting portion 351 may surround the first pocket portion 321 and the second pocket portion 322, thereby enhancing its function of gathering and supporting the breasts.

In addition, when viewed from the front, both the first connecting portion 351 and the opposite ends 351*a* and 351*b* of the first horizontal connecting portion 352 and opposite ends 352*a* and 352*b* of the second connecting portion 352 may be disposed outside a region between the first breast point BP1 and the second breast point BP2, respectively. That is, the first connecting portion 351 and the second connecting portion 352 may have a shape entirely surrounding the breasts. In addition, the first connecting portion 351 and the second connecting portion 352 may be integrally connected to each other by the third connecting portion 353 having low elasticity, thereby effectively preventing the breasts from being far apart from each other during an activity or exercise.

The fused brassiere described above is not limited to the configuration and method of the described embodiments. The above embodiments may be variously modified by selectively combining all or some of the respective embodiments with each other.

The invention claimed is:

1. A fused brassiere comprising:

an outer fabric having elasticity;

a lining having elasticity and configured to form a first pocket portion and a second pocket portion, the lining being bonded to the outer fabric by compressing the lining against an inner surface of the outer fabric to form the first and the second pocket portions;

a first cup-shaped pad portion and a second cup-shaped pad portion inserted into the first pocket portion and the second pocket portion, respectively; and a core member having no elasticity, formed in a region between the first pocket portion and the second pocket portion and in a circumferential portion of the first pocket portion and the second pocket portion, disposed between the outer fabric and the lining, and bonded together when the outer fabric and the lining are compressed against each other, wherein the outer fabric includes:

a front portion in which the first pocket portion and the second pocket portion are formed;

a shoulder support portion extending from an upper end of the front portion; and a rear portion extending from the shoulder support portion, coupled to side ends of the front portion, wherein edge and middle portions of the lining each have a bonding region in which the lining and the outer fabric are compressed against each other, and the core member is disposed in the bonding region of the edge and the middle portions, wherein the core member includes:

a first horizontal connecting portion connecting an edge of a lower end of the first pocket portion and that of the second pocket portion;

a second horizontal connecting portion connecting an edge of an upper end of the first pocket portion and that of the second pocket portion; and a vertical connecting portion connecting the first horizontal connecting portion and the second horizontal connecting portion to each other wherein the first cup-shaped pad portion includes a first breast point, and the second cup-shaped pad portion includes a second breast point, and when viewed from the front, the first horizontal connection portion, the second horizontal connection portion, and the vertical connection portion are disposed in an area between the first breast point and the second breast point, wherein the first horizontal connecting portion, the second horizontal connecting portion and the vertical connecting portion are formed integrally with one another.

2. The fused brassiere of claim 1, wherein the first horizontal connecting portion, the second horizontal connecting portion and the vertical connecting portion are formed as a band having a variable width.

3. A fused brassiere comprising:

an outer fabric having elasticity;

a lining having elasticity and configured to form a first pocket portion and a second pocket portion by being bonded to the outer fabric by being compressed against an inner surface of the outer fabric;

a first cup-shaped pad portion and a second cup-shaped pad portion inserted into the first pocket portion and the second pocket portion, respectively; and a core member made of a material having elasticity lower than the outer fabric, formed in a region between the first pocket portion and the second pocket portion and in a circumferential portion of the first pocket portion and the second pocket portion, disposed between the outer fabric and the lining, and bonded together when the outer fabric and the lining are compressed against each other, wherein the core member includes:

a first connecting portion formed to surround lower portions of the first pocket portion and the second pocket portion;

a second connecting portion formed to surround upper portions of the first pocket portion and the second pocket portion; and a third connecting portion connecting the first connecting portion and the second connecting portion to each other, wherein a first cup-shaped pad portion includes a first breast point, and a second cup-shaped pad portion includes a second breast point; and when viewed from the front, the second connecting portion is disposed higher than the first breast point and the second breast point, wherein the first connecting portion is formed to surround the first pocket portion and the second pocket portion so that when viewed from the front, opposite ends of the first connecting portion are disposed higher than the first breast point and the second breast point, respectively, wherein when viewed from the front, the opposite ends of the first connecting portion are disposed outside a region between the first breast point and the second breast point, respectively, when viewed from the front, opposite ends of the second connecting portion are disposed outside a region between the first breast point and the second breast point, respectively, wherein the first connecting portion is formed to surround each of the first pocket portion and the second pocket portion in a convex manner so as not to open the sides and then face upward, and wherein the third connecting portion extends in the vertical direction between the first connecting portion and the second connecting portion.

4. The fused brassiere of claim 3, wherein the outer fabric includes:

a front portion in which the first pocket portion and the second pocket portion are formed;

a shoulder support portion extending from an upper end of the front portion; and a rear portion extending from the shoulder support portion, coupled to side ends of the front portion.

5. The fused brassiere of claim 3, wherein edge and middle portions of the lining each have a bonding region in which the lining and the outer fabric are compressed against each other, and the core member is disposed in the bonding region of the edge and the middle portions.

6. The fused brassiere of claim 3, wherein the first connecting portion, the second connecting portion and the third connecting portion are formed integrally with one another.

7. The fused brassiere of claim 3, wherein the first connecting portion, the second connecting portion and the third connecting portion are formed as a band having a variable width.

* * * * *